United States Patent [19]

Klaus et al.

[11] 4,373,449

[45] Feb. 15, 1983

[54] LITERATURE SHELVING

[75] Inventors: Gerald R. Klaus, St. Charles; Thomas E. Williams, Schaumburg, both of Ill.

[73] Assignee: Fellowes Manufacturing, Itasca, Ill.

[21] Appl. No.: 159,458

[22] Filed: Jun. 16, 1980

Related U.S. Application Data

[63] Continuation-in-part of Ser. No. 111,709, Jan. 14, 1980, abandoned.

[51] Int. Cl.[3] ..... A47B 57/00

[52] U.S. Cl. ..... 108/60; 248/174; 211/135

[58] Field of Search ..... 108/60, 61; 211/135, 211/149, 148; 248/174

[56] References Cited

U.S. PATENT DOCUMENTS

| | | | |
|---|---|---|---|
| 1,323,560 | 12/1919 | Van Doorn . | |
| 1,592,497 | 7/1926 | Mays . | |
| 2,061,485 | 11/1936 | Scheinman . | |
| 2,274,046 | 2/1942 | Derman . | |
| 2,277,155 | 3/1942 | Scheinman . | |
| 2,733,112 | 1/1956 | Durham . | |
| 2,805,909 | 9/1957 | Derman . | |
| 2,904,382 | 9/1959 | Mitten . | |
| 3,107,012 | 10/1963 | Rothenberg . | |
| 3,415,585 | 12/1968 | Morris . | |
| 3,494,685 | 2/1970 | Fiterman et al. . | |
| 3,583,783 | 6/1971 | Murphy . | |
| 3,628,842 | 12/1971 | Wright . | |
| 3,881,428 | 5/1975 | Klecki | 108/60 |
| 3,999,662 | 12/1976 | Barnhardt . | |
| 4,062,302 | 12/1977 | Krizan | 108/60 |

*Primary Examiner*—Francis K. Zugel

*Attorney, Agent, or Firm*—Hume, Clement, Brinks, Willian & Olds, Ltd.

[57] ABSTRACT

The present invention provides a multiple-partitioned shelf unit comprising a rigid open-ended shelf having a four-sided, substantially horizontal floor, a four-sided substantially horizontal ceiling, and means supporting said ceiling above said floor. The supporting means includes two spaced-apart upstanding members defining therebetween the horizontal extent of the shelf open end. The ceiling further includes a downwardly-extending lip. The free end of the lip and floor define therebetween the vertical extent of the shelf open end. The shelf unit further includes a fiberboard shell having an upstanding rear panel hingedly connected to two upstanding side panels. The shell is positioned within the shelf with said rear panel rearward of the shell's open end and the free ends of the side panels each being disposed at opposite ends of shelf open end, each adjacent and inward of one of the upstanding members, and at least a portion of each of the side panels extends behind the lip. Further included is means forming fiberboard compartments open to said shelf open end wherein the compartment-forming means extend between the side panels and, together with the adjacent upstanding member, said lip, and the rear panel, hold the side panels in a stationary upright position.

12 Claims, 14 Drawing Figures

FIG. 1
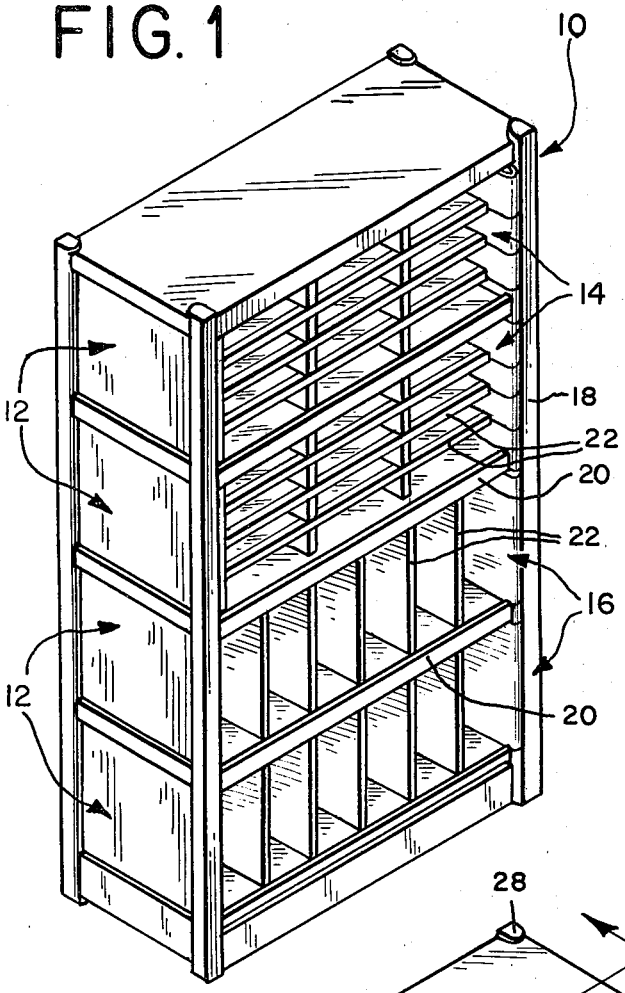
FIG. 3
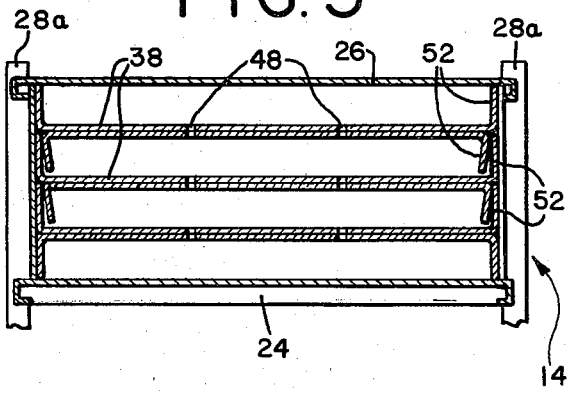
FIG. 4
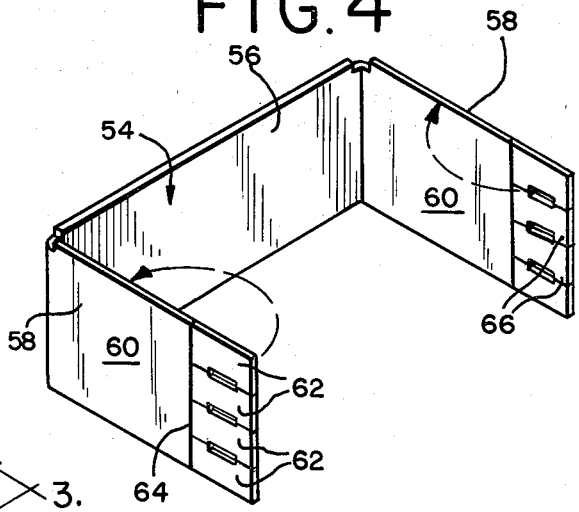
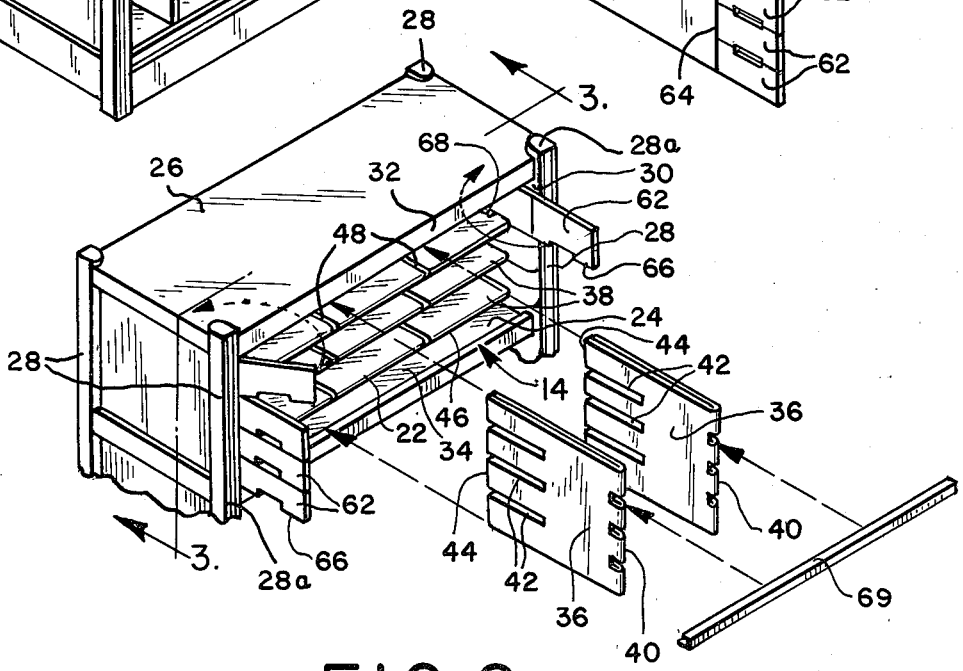
FIG. 2

LITERATURE SHELVING

This application is a continuation-in-part application of copending U.S. patent application Ser. No. 06/111,709, filed on Jan. 14, 1980, now abandoned.

TECHNICAL FIELD

The present invention is an improved shelf compartment unit for storing and sorting documents, mail, and the like, which has a plurality of open-ended compartments. More specifically, the present invention provides a combination of a standard, open-framework shelving unit and compartment-forming fiberboard inserts therefor.

BACKGROUND OF THE INVENTION

Fiberboard compartment-forming inserts for a rigid shelving unit are an advantageous construction for office use and the like. If the fiberboard inserts are collapsible and formed so as to be interchangeable between those forming wide horizontal compartments, those forming tall vertical compartments, and combinations thereof, a single rigid shelf unit can be converted easily to current demands. The fiberboard portions of such units should be easy to assemble, without conventional nuts and bolts, yet be sufficiently sturdy to hold the weight of the material stored therein and the wear of sorting usage, for instance when such a unit is used once or twice daily for sorting office mail or for holding periodicals in a library or the like.

Means have been sought to provide an easy to assemble fiberboard insert that nonetheless, once assembled, cannot be dislodged from the shelf on which it sits. For instance, the inserts disclosed in U.S. Pat. No. 4,062,302 are provided with partitions that fold outwardly so as to be trapped behind the side posts of the rigid shelving units. When an open-framework rigid shelving unit is utilized, however, it is desirable to provide rear and side fiberboard walls and to have the insert, including shelve edges and side walls, flush with the open end of the rigid shelving unit, so that material stored therein cannot be trapped behind the side posts. To achieve this end, the side walls, providing support to at least horizontally disposed fiberboard partitions, should extend up to the open end. Such a design precludes trapping portions of the fiberboard insert behind the side posts.

DISCLOSURE OF THE INVENTION

The present invention provides an easy to assemble, interchangeable, fiberboard compartment-forming inserts that sit flush with the open end of the associated rigid shelving unit. Both tall and wide compartments and combinations thereof are formed within three-sided shells that, at their forward edges, are disposed between upright forward posts. Fiberboard compartment-forming means are disposed between the sides of the shell and, together with the forward posts, prevent side-wise displacement of the insert. A lip from the ceiling above prevents movement of the insert outward of the open end.

DESCRIPTION OF THE DRAWINGS

FIG. 1 is a perspective view of a shelf compartment unit having a plurality of multiple-partitioned shelf units embodying features of the present invention;

FIG. 2 is a enlarged, partially-exploded perspective view of a multiple-partitioned shelf unit of the shelf compartment of FIG. 1 embodying features of the present invention;

FIG. 3 is a cross-sectional view of the multiple-partitioned shelf unit of FIG. 2 taken along line 3—3 of FIG. 2;

FIG. 4 is a perspective view of a shell of the shelf unit of FIG. 2;

PREFERRED EMBODIMENT OF THE INVENTION

Figure 5:
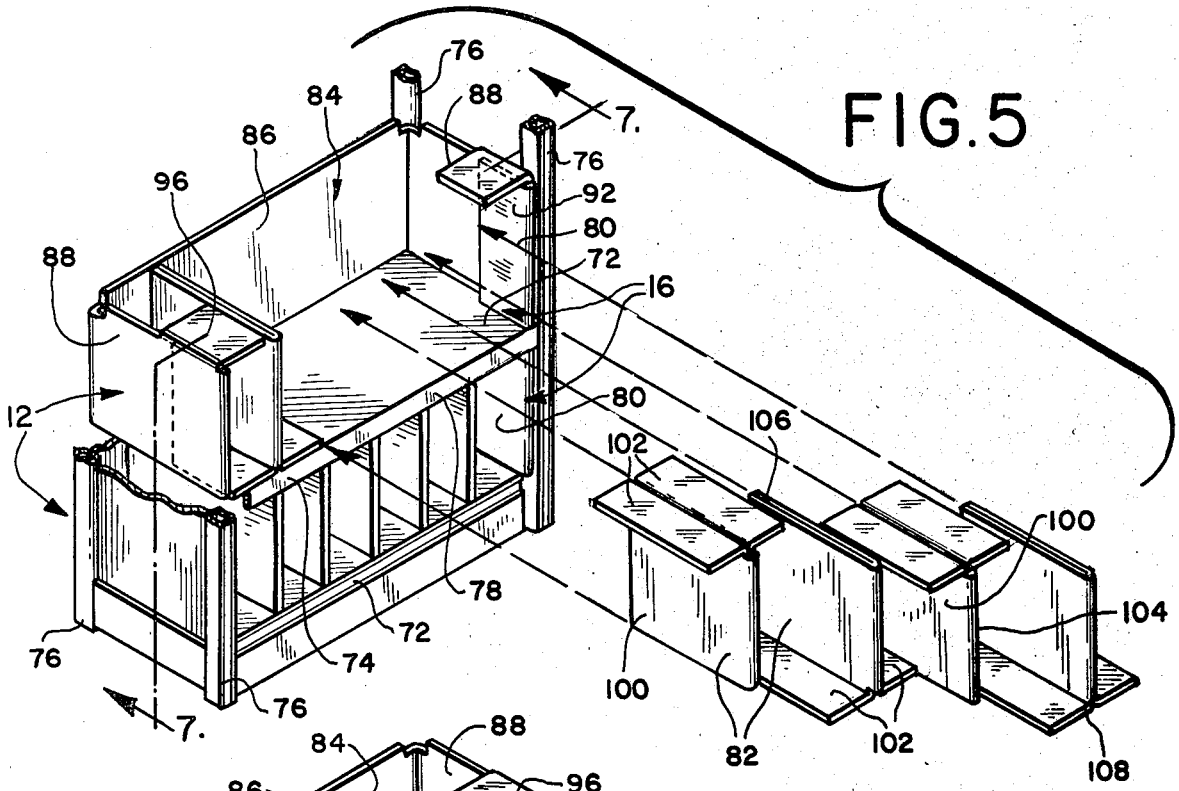
FIG. 5 is an enlarged, partially-exploded perspective view of a multiple-partitioned shelf unit of the shelf compartment unit of FIG. 1 embodying features of the present invention.

The invention, as shown in FIG, 1, provides a shelf compartment unit, designated generally by the reference numeral 10, having a plurality of shelf units 12. The shelf units 12 shown in FIG. 1 include two preferred embodiments of shelf units, i.e., shelf units 14 having horizontal compartments and shelf units 16 having vertical compartments.

The shelf compartment unit 10 can be considered as including a rigid frame 18 having a plurality of horizontal shelf members 20 which frame 18 and shelf members 20 can be formed of any rigid material, such as metal, wood, high density plastic or the like. Between the horizontal shelf members 20 are various fiberboard partitions, designated generally 22, which will be described in more detail below. For simplicity, the shelf compartment unit 10 will, however, hereinafter be described in terms of its segments comprising individual shelf units 12 although it is to be understood that each shelf unit 12 includes a portion of the rigid frame 18 and two adjacent horizontal shelf members 20.

Referring now to FIG. 2, there is shown a shelf unit 14 having a rigid floor 24, a rigid ceiling 26, and four rigid upstanding members 28 disposed therebetween, supporting the ceiling 26 above the floor at the corners. The upstanding members 28 are preferably square or rectangular in cross-section. The shelf unit 14 has a forward open end 30, the horizontal extent of which is defined by the inner sides of the two opposed, forward upstanding members **28*a* and the vertical extent of which is defined by the floor 24 and a downwardly-extending lip 32 of the ceiling 26**.

Between the floor 24 and ceiling 26, and between the four upstanding members 28, are a plurality of fiberboard partitions 22 forming a compartmentalized grid 34. The compartmentalized grid 34, more specifically, as shown, is formed of two vertically-disposed, or vertical, fiberboard partitions 36, and three horizontally-disposed, or horizontal, partitions 38. Each vertical partition 36 is formed of a single fiberboard blank scored and folded at its forward edge 40. Each partition 36 further includes three slots 42 extending from its rear edge 44 towards its forward edge 40, terminating about midway. Each horizontal partition 38 is likewise formed of a fiberboard blank that is scored and folded at its forward edge 46 and includes two slots 48 extending from its forward edge 46 towards its rear edge (not shown), terminating about midway. The slots 42 of the vertical partitions 36 receive the horizontal partitions 38 about their rear-most halves. The slots 48 of the horizontal partitions 38 receive the vertical partitions 36 about their forward halves. The partitions 36, 38 are thereby locked together.

Referring now to FIG. 3 also, the horizontal partitions 38 are flanked by end flaps 52, i.e., pairs of upwardly and downwardly extending panels hingedly secured to each side of each partition 38. The end flaps 52 are each foldable inwardly towards the partition 38, and when struck outward so as to be aligned vertically, act as feet spacing-apart adjacent partitions 38. The end flaps 52 of each partition 38 overlap the adjacent end flaps 52 of the adjacent partitions 38.

Referring now to FIG. 4 also, the compartmentalized grid 34 further includes a three-sided fiberboard shell 54. The shell 54 includes a rear panel 56 flanked by, and hingedly secured to, spaced-apart side panels 58. The panels 56, 58 of the shell 54 are supported on, and upstand from, the floor 24 of the shelf unit 14. The side panels 58 are each formed with a side wall 60, extending from the rear panel 56 to the free-end 64 of the side panel 58, and four side flaps 62 which are hingedly secured to the side wall 60 at the free-end 64 of the side panel 58. The side flaps 62 each are foldable inwardly upon the side wall 60, and together with the side wall 60, sandwich the partition end flaps 52 therebetween, holding the end flaps 52 in vertical alignment.

The free-ends 64 of the side panels 58 are disposed adjacent and inward of the adjacent forward upstanding members 28*a*. The locked-together partitions 36, 38 together with rear panel 56 and the forward upstanding members 28*a*, hold the side panels 58 upright and stationary from movement transverse of the open end 30. The side panels 58 additionally are preferably formed with side walls 60 that are higher than the open end 30, i.e., side walls 60 that extend behind the lip 32 of the ceiling 26. The side flaps 62, however, do not extend behind the lip 32 so as to remain freely swingable outwardly through the open end 30. The lip 32 prevents movement of the side panels 58, and therefore movement of any portion of the compartmentalized grid 34, outward of the shelf unit 14 through the open end 30. In addition, the side flaps 62 are preferably formed with tabs 66 that are received by slots 68 in the horizontally-disposed partitions 38 closely adjacent the partition end flaps 52.

Assembly of the compartmentalized grid 34 is best achieved by first inserting the shell 54 through the open end 30 in a knocked-down disposition, i.e., side panels 58 are folded inwardly, adjacent the rear panel 56. The shell 54 is then stood up and unfolded, the side flaps 62 being swung outwardly through the open end 30. The horizontal partitions 38 are then slid into the shell 54, their partition end flaps 52 aligned vertically, and the side flaps 62 are swung inwardly to the end flaps 52, and the tabs 66 and slots 68 are interlocked. The vertically-disposed partitions 36 are then slid in, receiving and being received by the horizontal partitions 38. Preferably, the vertical partitions 36 are cut away at their forward edges 40 about the horizontal partitions 38 allowing the forward edges 46 of the horizontal partitions 38 to be received and protected by rigid, channelled cross-braces 69.

Referring now to FIG. 5, there is shown, in one embodiment, shelf units 16 having a plurality of fiberboard partitions 22 forming a vertically struck compartmentalized grid 70. The shelf unit 16 similarly includes a floor 72, a ceiling 74, four upstanding members 76, which together with a lip 78 on the ceiling 74 define a forward open end 80.

The compartmentalized grid 70 is formed of a plurality of upstanding T-shaped fiberboard partitions 82 and a three-sided fiberboard shell 84. The shell 84 includes a rear panel 86 flanked by, and hingedly secured to, side panels 88. Each side panel 88 is formed of a side wall 90 and a side flap 92 which are hingedly secured together at the forward edge 94 of the side panel 88. The side flaps 92 additionally include side flap tabs 96 that extend toward each other and are hingedly secured to (as shown) the upper edges 98 of the side flaps 92, although, the side flap tabs 96 could be secured to the lower edges of the side flaps 92 if the adjacent T-shaped partition 82 was disposed upside-down of the position illustrated.

Figure 6:
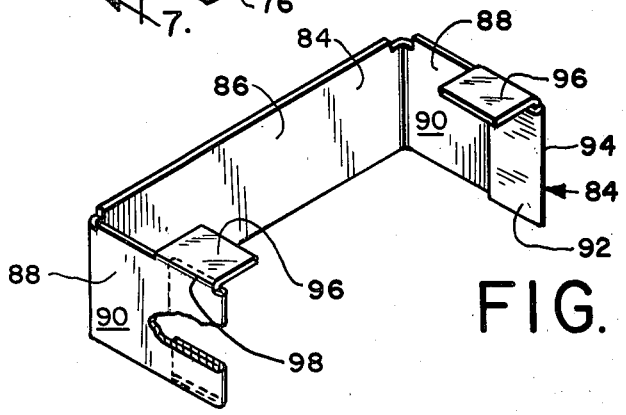
FIG. 6 is a perspective view of a shell of the shelf unit of FIG. 5.
Figure 7:
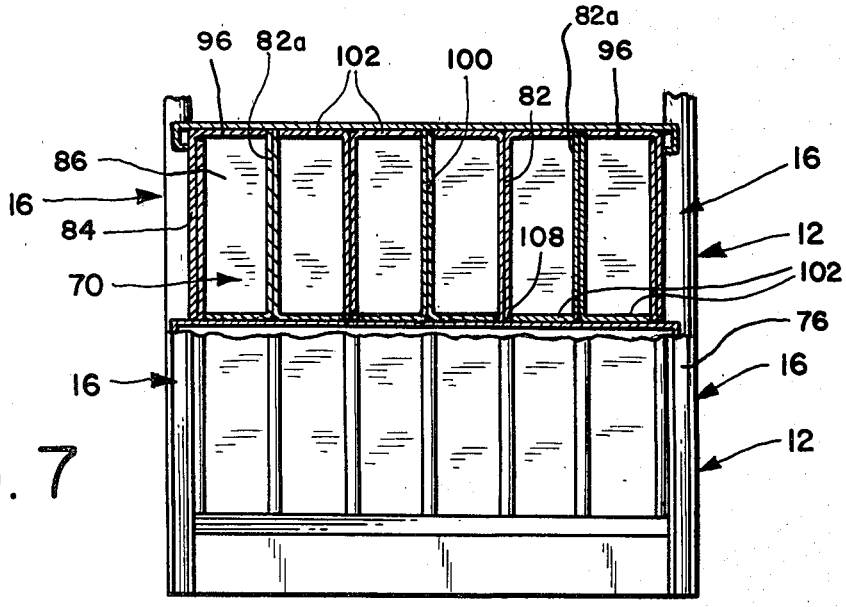
FIG. 7 is a cross-sectional view of the shelf unit of FIG. 5 taken along line 7—7 of FIG. 5.

Referring now to FIGS. 6 and 7 also, the T-shaped partitions 82 each include a partition wall 100 and end flaps 102, which end flaps 102 form the cross-bar of the cross-sectional "T". The partition 82 can be formed of a single fiberboard blank scored and folded in half to form a double-layered partition wall 100 with a forward edge 104 at the fold line. The end flaps 102 are hingedly secured, i.e., scored and folded, along either the top or bottom edge 106, 108 of the partition wall 100, depending on its disposition.

Partitions 82 are disposed within the shell 84, forward edges 104 adjacent the open end 80, extending toward and up to the rear panel 86 in a spaced-apart alignment. The T-shaped partitions 82 alternate between those having its end flaps 102 at its bottom edge 108 and those having its end flaps 102 at its top edge 106. (All T-shaped partitions 82 are in fact the same and can otherwise be considered as disposed alternatingly right-side-up and up-side-down.) The end flaps 102 extend up to the adjacent partition wall 100, acting as spacing members. As shown, the T-shaped partitions 82*a* adjacent the side panels 88 both have their end flaps 102 at the bottom edges 108 of their partition walls 100, the side flap tabs 96 acting as upper spacing members.

The partition end flaps 102 and side flap tabs 96 frictionally engage the sides of adjacent partition walls 100, not only maintaining the T-shaped partitions 82 in upright, spaced-apart alignments, but holding the shell 84 against movement transverse of the open end 80. Moreover, all partition end flaps 102 secured at the top edges 106 of partition walls 100, and the side flap tabs 96, lie in abutting relationship to the ceiling 74, behind the ceiling lip 78. Movement of the compartmentalized grid 70 outward through the open end 80 is thereby prevented.

Figure 8:
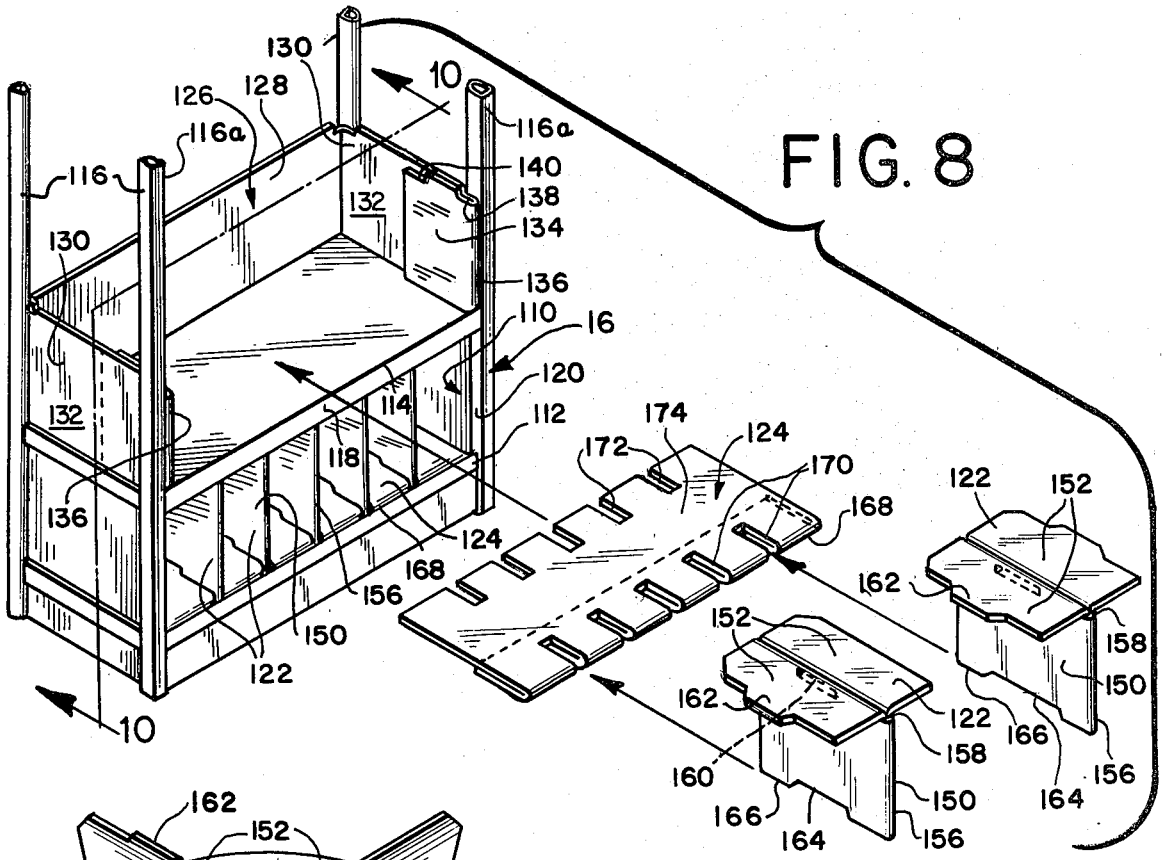
FIG. 8 is an enlarged, partially-exploded view of a multiple-partitioned shelf unit of the shelf compartment of FIG. 1 embodying features of the present invention.

Referring now to FIG. 8, there is shown, in a second embodiment, shelf units 16 having a plurality of fiberboard partitions 22 forming a vertically struck compartmentalized grid 110. Each shelf unit 16 again includes a floor 112, a ceiling 114, and four upstanding members 116, the forward two of which 116*a* together with a lip 118 on the ceiling 114 define a forward open end 120.

The compartmentalized grid 110 is formed of a plurality of upstanding T-shaped fiberboard partitions 122, a fiberboard partition base 124, and a three-sided shell 126. The shell 126 includes a rear panel 128 flanked by, and hingedly secured to, side panels 130. Each side panel 130 is formed of a side wall 132 and a side flap 134 that are hingedly secured together at the forward edge 136 of the side panel 130. The side flaps 134 include cut away portions 138 about their forward upper edges and the side flaps 134 include a rear cut-away portion forming a shoulder 140, the purpose of which is explained below.

Figure 9:
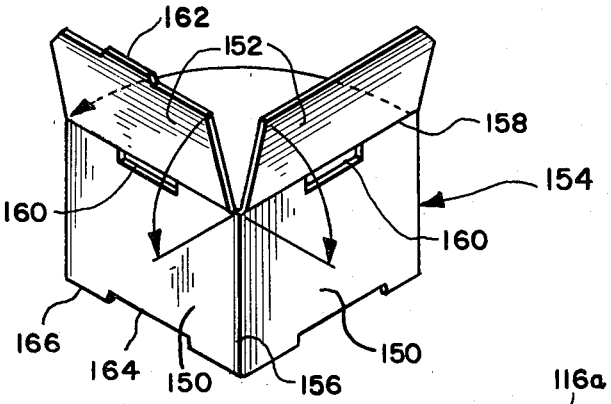
FIG. 9 is a perspective view of a blank forming a partition of the shelf unit of FIG. 8.
Figure 10:
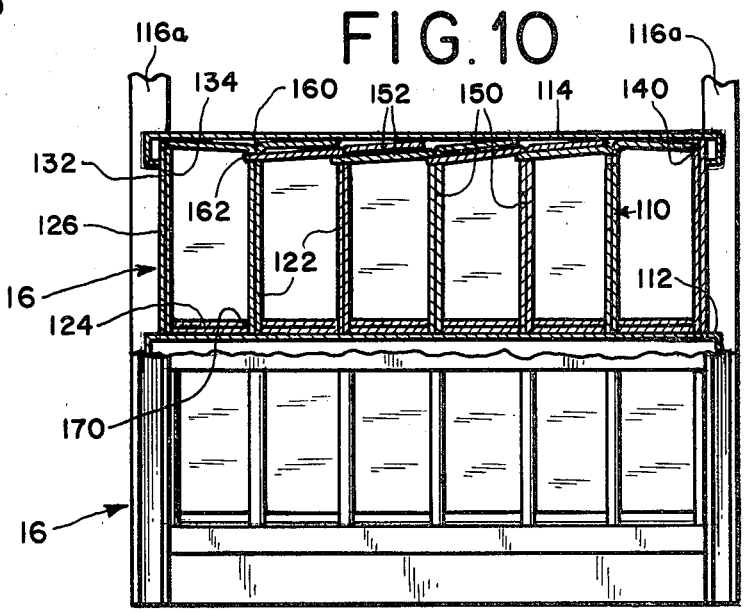
FIG. 10 is a cross-sectional view of the multiple-partitioned shelf unit of FIG. 8, taken along line 10—10 of FIG. 8.
Figure 11:
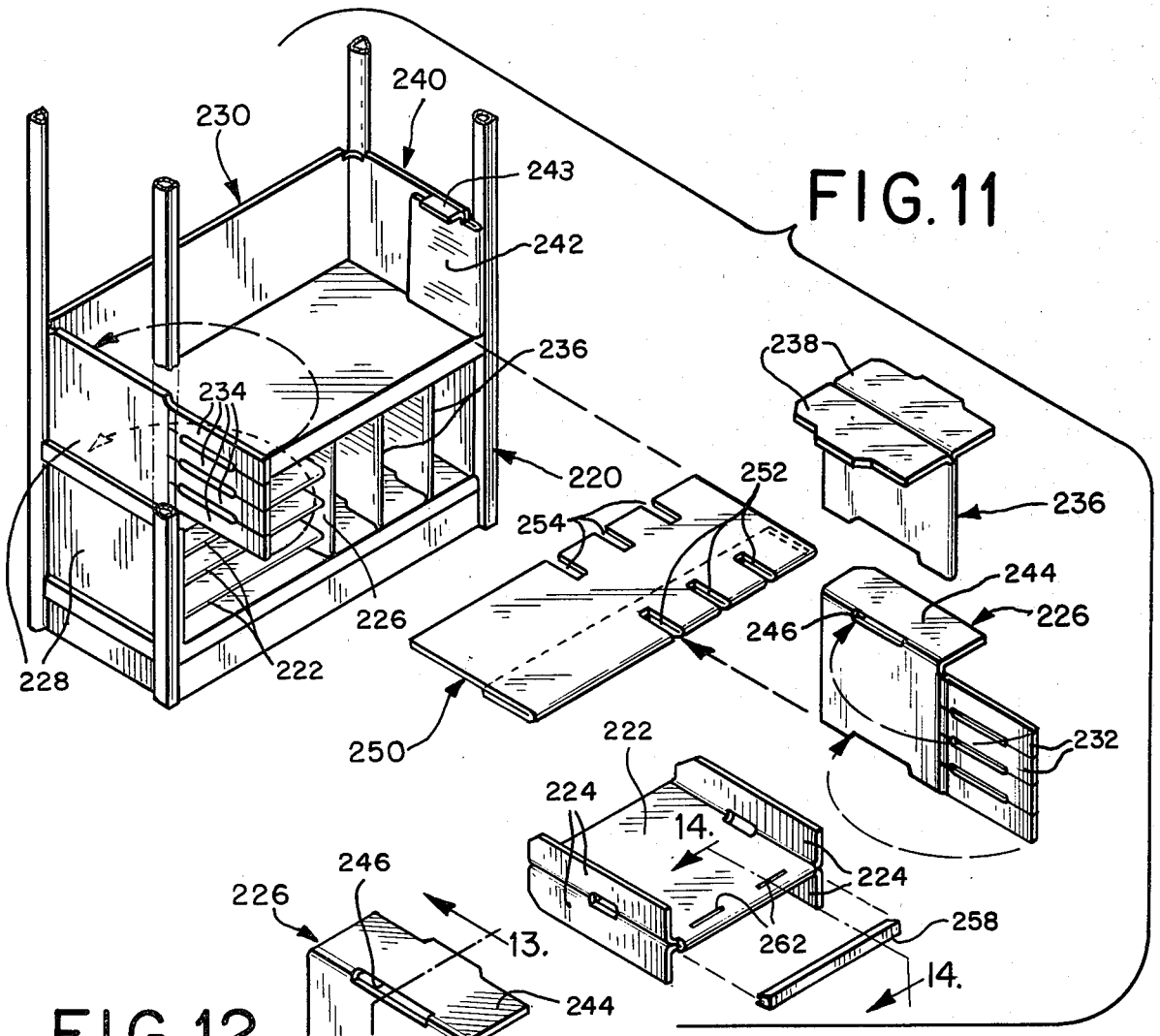
FIG. 11 is a partially-exploded view of a multiple-partitioned shelf unit embodying features of the present invention.
Figure 12:
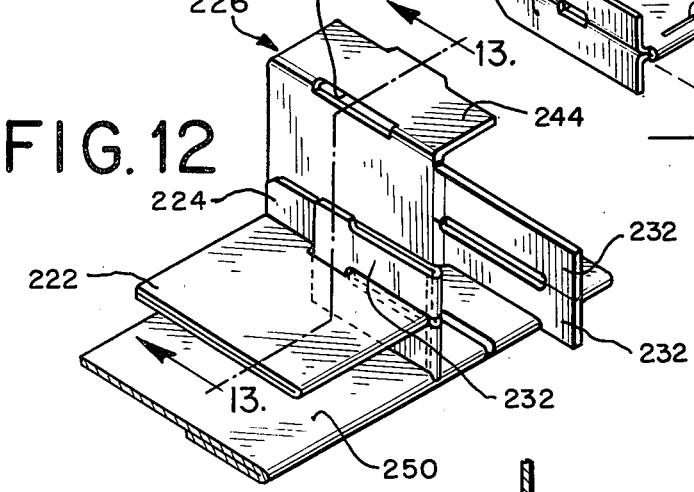
FIG. 12 is an enlarged sectional view of a portion of the shelf unit of FIG. 11.
Figure 13:
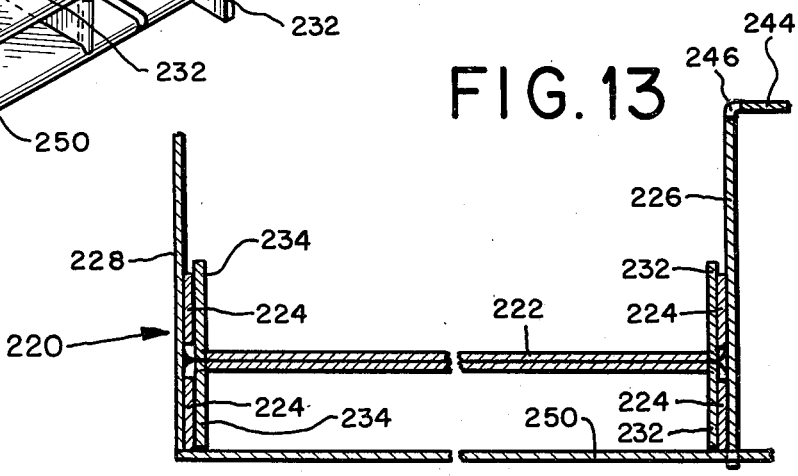
FIG. 13 is a cross-sectional view of the shelf unit of FIG. 11, taken along line 13—13 of FIG. 12.

Referring now to FIGS. 9 and 10 also, the T-shaped partitions 122 each include a partition wall 150 and end flaps 152 which end flaps 152 form the cross-bar of the cross-sectional "T". The partition 122 can be formed of a single fiberboard blank 154 (shown partially open in FIG. 9) scored and folded in half to form a double-layered partition wall 150 with a forward edge 156 at the fold line. The end flaps 152 are hingedly secured, i.e., scored and folded, along the top edge 158 of the partition wall 150.

The partitions 122 further include slots 160 extending through the partition wall 150 closely adjacent to its top edge 158. One of the end flaps 152 of each partition 122 further includes a tab 162 that extends into the slot 160 of the adjacent partition 122 when positioned within the shelf unit 16, locking one partition 122 to the adjacent partition 122. At least the right-most partition 122 includes a tab 162 on each end flap 152 so that the right-most tab 162 sits upon the shoulder 140 of the right side flap 134 as does the left-most tab 162. The partition walls 150 each include a notch 164 at their lower edges 166.

The partition base 124 of the compartmentalized grid 110 is preferably formed of a fiberboard blank, scored and folded under against itself to form at least a double-layered forward edge 168. The base 124 includes a plurality of aligned forward and rearward slots 170, 172 that form therebetween upraised floor portions 174 that are received by the notches 164 of the partition walls 150, firmly seating the partitions 122.

The partitions 122 are disposed within the shell 126 in spaced-apart, interlocked and seated alignment. Both the end flaps 152 and the partition base 124 act as spring and locking members. The end flaps 152 adjacent the side flaps 134 are related to the side flaps 134 as described above and, together with the partition base 124 which also abuts the side flaps 134, hold the shell 126 against movement transverse the open end 120. Moreover, all of the end flaps 152 are disposed behind the lip 118 at the open end 120 and the side panels 130 of the shell 126 extend up to the open end 120 between the forward most upstanding members 116*a* and are cut away about the portion disposed below the lip 118 but otherwise, extend about up to the ceiling 114. Thus, neither the T-shaped partitions 122 nor the shell 126 can be accidentally dislodged in a forward direction through the open end 120.

For simplicity in manufacture and assembly, the T-shaped partitions 122 can be each formed with tabs 162 on each of their end flaps 152 so that there is no need to differentiate between the right-most and the remaining partitions 122.

Referring now to FIGS. 11, 12, 13, and 14 there is shown compartmentalized grid 220 having a combination of horizontally and vertically struck components. The grid 220 includes a plurality of horizontal partitions 222 which are flanked by end flaps 224, which again are upwardly and downwardly extending panels which act as feet, spacing-apart adjacent partitions 222.

At one end of the horizontal partitions is a vertical partition 226, and the other end a side panel 228 of a three-sided fiberboard shell 230. Both the vertical partition 226 and the side panel 228 include a plurality of side flaps 232, 234 that are hingedly secured to the forward edges of the vertical partition 226 and the side panel 228 respectively. The side flaps 232, 234 fold inwardly, and sandwich the partition end flaps 224, holding the end flaps in vertical alignment.

The vertically struck portion of the grid 220 is formed of a plurality of T-shaped fiberboard partitions 236. The partitions 236 each have two end flaps 238 with underlying slots (not shown). The adjacent side panel 240 of the shell 230 has a shouldered inner panel 242 and an inwardly extending tab 243. The vertical partition 226 of the horizontal portion also has an end flap 244 and a slot 246. The T-shaped partitions 236 fit together with the side panel 240 and vertical partition 236 as described above in other embodiments.

A base panel 250 with a plurality of aligned forward and rear slots 252, 254 receive the middle-notched bottom edges of all the vertical partitions 226, 236.

Figure 14:
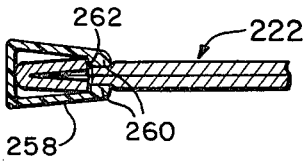
FIG. 14 is a cross-sectional, fragmented view of the shelf unit of FIG. 11, taken along line 14—14 of FIG. 11.

The horizontal partitions 222 are each preferably provided with a channeled cross brace 258 formed preferably of a plastic or similar material having a degree of flexibility. The cross brace 258 includes inwardly extending flanges 260 along the horizontal partition 222, as best seen in FIG. 14. A cross brace 258 is best attached to a partition 222 by sliding it on from an end prior to assembly. Once secured, the abutment of flanges 260 and shoulder-forming slots 262 substantially prevent dislodgement upon force in the forward direction.

INDUSTRIAL APPLICABILITY OF THE INVENTION

Shelf compartmental units 10 within the present invention are particularly useful in offices and the like for sorting and storing documents, mail and similar objects, which can be stored flat or horizontally or both depending upon choice of shelf unit. The fiberboard partitions can be formed so as to be interchangeable between horizontal compartments, vertical compartments, and combinations thereof.

We claim:

1. A multiple-partitioned shelf unit comprising:

a rigid shelf having a shelf open end comprising a four-sided, substantially horizontal floor, a four-sided, substantially horizontal ceiling, and means supporting said ceiling above said floor, said means including two spaced-apart upstanding members defining therebetween the horizontal extent of said shelf open end, wherein said ceiling further includes a downwardly-extending lip, the free end of said lip and floor defining therebetween the vertical extent of said shelf open end;

a fiberboard shell having an upstanding rear panel hingedly connected to two upstanding side panels opposite free ends of said side panels, said shell being positioned within said shelf with said rear panel rearward of said shell open end and said free ends of said side panels each disposed at opposite ends of said horizontal extent of said shelf open end, each adjacent and inward of one of said upstanding members, and at least a portion of each of said side panels extending behind said lip; and means forming fiberboard compartments open to said shelf open end wherein said compartment-forming means extend between said side panels and, together with said adjacent upstanding member, said lip and side rear panel, hold said side panels in a stationary upright position.

2. The shelf unit of claim 1 wherein each of said side panels is formed of a side wall, extending between said rear panel and said side panel free end, and a plurality of side wall flaps each hingedly secured to said side wall at said free end of said side panel; and wherein said compartment-forming means includes a plurality of horizontal fiberboard partitions including at each end an upwardly and a downwardly extending partition end flap, said horizontal partitions each extending between said opposed side panels, and said partition end flaps each being sandwiched between one of said side walls and one of said side wall flaps, each partition end flap overlapping and being substantially coextensive with, the adjacent end flap of the adjacent horizontal partition.

3. The shelf unit of claim 2 wherein said horizontal partitions each are formed with at least one slit extending from the edge of said horizontal partition adjacent said shelf open end towards said rear panel; and wherein said compartment-forming means further includes at least one vertical partition being formed with a plurality of slits each extending from said vertical edge adjacent said rear panel towards said shelf open end, said horizontal and vertical partitions being disposed so that said vertical partition slits each receive the rear portion of said horizontal partitions, and said horizontal partition slits receive the forward portion of said vertical partition.

4. The shelf unit of claim 3 wherein at least one of said horizontal partitions includes a slot closely adjacent the hinge connection to said partition end flaps;

and wherein at least one of said side wall flaps flanking said slotted horizontal partition includes a tab that is received by said slot.

5. The shelf unit of claim 1 wherein said compartment-forming means includes a plurality of fiberboard T-shaped vertical partitions having extending flaps to form the T-shape, said partitions being aligned and spaced so that the flaps of each partition extend to adjacent partitions.

6. The shelf unit of claim 5 wherein said side panel is formed of a side wall extending between said rear panel and said side wall free end, and a side wall flap hingedly interconnected at said side wall free end, each of said side wall flaps being disposed inwardly and closely adjacent said side wall and further including a tab that lies adjacent one of said floor and ceiling, and extends to the adjacent vertical panel.

7. The shelf unit of claim 1 wherein a first of said side panels is formed of a side wall, extending between said rear panel and said side panel free end, and a plurality of side-wall flaps each hingedly secured to said side wall at said free end of said side panel; and wherein said compartment-forming means includes a plurality of horizontal fiberboard partitions including at each end an upwardly and a downwardly extending partition end flap, said horizontal partitions each extending between said first side panel and a first vertical partition, said first vertical partition having a plurality of side wall flaps each hingedly secured at its forward edge, and said partition end flaps each being sandwiched between either one of said side walls adjacent said first side panel or said first vertical partition and one of said side wall flaps, each partition end flap overlapping and being substantially coextensive with, the adjacent end flap of the adjacent horizontal partition.

8. The shelf unit of claim 7 wherein compartment-forming means further includes a plurality of fiberboard T-shaped vertical partitions disposed between a second side panel and said first vertical portion and having extending flaps to form the T-shape, said partitions being aligned and spaced so that the flaps of each partition extend to adjacent partitions.

9. The shelf unit of claim 8 including a second side panel formed of a side wall extending between said rear panel and said side wall free end, and a side wall flap hingedly interconnected at said side wall free end, said side wall flap being disposed inwardly and closely adjacent said second side wall and further including an upper shoulder.

10. The shelf unit of claim 9 further including at least one channeled cross brace provided with inwardly extending flanges at its free ends and wherein at least one of said horizontal partitions is provided with at least one slot, said flanges substantially abutting the edge of said slot when said cross brace is disposed on the forward edge of said slotted horizontal partition.

11. The shelf unit of claim 5 wherein at least one of said flaps of said fiberboard T-shaped vertical partitions includes a tab and said T-shaped vertical partitions also include at least one slot near said flaps for receiving the tab of an adjacent vertical partition flap such that said vertical partitions are interlocked with one another.

12. The shelf unit of claim 5 wherein said T-shaped vertical partitions are provided with lower notches and further including a fiberboard partition base having aligned forward and rearward slots that form upraised floor portions received by the lower notches of said vertical partitions.

* * * * *